United States Patent [19]

Kitsuda

[11] 3,964,412

[45] June 22, 1976

[54] SHAPING APPARATUS AND A METHOD FOR PRODUCING A SEAMLESS CONTAINER

[76] Inventor: Kaname Kitsuda, 115, Shinshu, Hiratsuka, Kanagawa, Japan

[22] Filed: Apr. 9, 1974

[21] Appl. No.: 459,353

[52] U.S. Cl. ..... 113/7. R; 113/1 G; 113/120 H; 113/120 S

[51] Int. Cl.[2] ..... B21D 51/24

[58] Field of Search ..... 113/1 G, 7 R, 120 H, 113/120 S

[56] References Cited

UNITED STATES PATENTS

| | | | |
|---|---|---|---|
| 529,597 | 11/1894 | Cayley et al. | 113/120 S |
| 840,270 | 1/1907 | Thiel | 113/120 H |
| 1,948,437 | 2/1934 | Bowers | 113/120 S |
| 2,026,133 | 12/1935 | Mapes | 113/120 S |
| 2,396,218 | 3/1946 | Watters | 113/120 H |
| 2,791,674 | 5/1957 | Westin et al. | 219/154 |
| 3,196,819 | 7/1965 | Lechner et al. | 113/120 H |
| 3,446,167 | 5/1969 | Armbruster | 113/7 R |
| 3,606,968 | 9/1971 | Loyd | 279/41 |
| 3,707,407 | 12/1972 | Spielmann | 113/120 H |

*Primary Examiner*—C. W. Lanham
*Assistant Examiner*—Gene P. Crosby
*Attorney, Agent, or Firm*—Michael J. Striker

[57] ABSTRACT

This invention relates to a shaping device in a circulation system for producing a high pressure gas container by successively shaping a workpiece at a series of workstations. The device comprises a turn table, a plurality of holding frames, a series of drawing dies and an annealing means. The turn table is provided with a plurality of holding frames which are circumferentially arranged on said turn table at equally spaced distances and is adapted to turn in one direction and to stop alternately at each position of the holding frames. Each of the drawing dies comprises punch and a die combination whose dimensions gradually vary so that a bottomed steel cylinder can be successively drawn at each workstation and form a gas container having a narrow, thick opening. The drawing dies are installed in series right above the stop positions of the holding frames except the stop positions for mounting or charging, heating and demounting or discharging the steel cylinder. The heating means is positioned at the second stop position, after the first stop position at which mounting of the steel cylinder occurs or at any subsequent stop position where the workpiece may still be drawn. A ringed high frequency induction heater attached to the heating means is fitted right above the holding frame at the stop position for heating the workpiece. The bottomed steel cylinder material is mounted in and clamped to the holding frame and is gradually drawn into the shape of a gas container by the drawing dies in series.

14 Claims, 3 Drawing Figures

SHAPING APPARATUS AND A METHOD FOR PRODUCING A SEAMLESS CONTAINER

This invention relates to an automatical drawing device in a circulation system for producing a high pressure gas container by successively shaping the workpiece at a series of workstations without electric welding. The workpiece is a steel cylinder having a closed bottom which is previously made from one sheet of steel plate by a drawing process.

Therefore, one object of this invention is to provide a high pressure gas container comprising a narrow opening portion, a shoulder portion and a trunk portion having a bottom without a welding line.

Another object of this invention is to provide a high pressure gas container of which an opening portion is made thicker than a trunk portion in thickness in order to thread the opening portion.

Still another object of this invention is to provide a high pressure gas container which is sturdy and inexpensive in its construction.

Heretofore, in the prior art production of a high pressure gas container, an opening portion and a trunk portion have been separately drawn from two sheets of steel plate and welded by electricity or gas in order to make one body. Therefore, the conventional gas container has a welding line and is non-resistant to internal pressure and unsightly at the welded portion. Moreover the welding process requires a great deal of labor and time, and the welded portion must be strong enough to withstand the internal pressure of any fluid or gas stored in the gas container. For these reasons, the conventional production of the gas container has been very expensive and inefficient.

Briefly stated in accordance with this invention, there is provided an automatical drawing device in a circulation system and method for successively drawing a container which includes an annealing process for producing a non-welded sturdy gas container.

The drawing device comprises a turn table, a plurality of holding frames, a series of drawing dies and a heating means. The turn table is provided with the holding frames which are circumferentially arranged on said turn table at equally spaced distances and is adapted to turn in one direction and stop alternately at each die position. Therefore, the holding frames revolve equal circumferential distances together with the turn table and stop, in turn, at discrete positions on a device bed. A series of the drawing dies are installed right above each stop position of the holding frames, except for the stop positions where mounting, annealing and demounted a bottomed steel cylinder is executed. Each of the drawing dies comprises a punch having an outer cylindrical surface and a die having an inner cylindrical and downwardly widened shoulder-shaped surface. At each successive drawing die a gradual variation of the shapes of the punch and the die successively draws an upper portion of a steel cylinder into a narrow and thick opening portion. A ringed high frequency induction heater which projects laterally from the heating means is fitted right above the holding frame at the stop position for annealing. All of the drawing dies and the high frequency induction heater are adapted to reciprocate simultaneously and vertically. When the holding frame stops at the charging position, a bottomed steel cylinder is mounted therein by inserting the closed bottom downwards; thereby fastening the latter. The steel cylinder is directed in turn to each of the positions of the drawing dies by the revolution of the holding frame together with the movement of the turn table. In this manner the upper portion of the steel cylinder is gradually drawn without any wrinkling or rumpling by the successively located drawing dies into a narrow and thick opening portion and a shoulder portion. However, the repetitive drawing process hardens the upper portion of the steel cylinder and the subsequent drawing operations can only operate with great difficulty. Therefore an annealing process is required. Heretofore, the heating process was executed by removing a semi-processed steel cylinder from the main production line. This removal required a great deal of labor and time. By contrast, this invention incorporates the heating process into the main production or circulation system. The heating process employs a high frequency induction heater which heats only the upper portion of the steel cylinder to a high temperature in a short time; thereby heating only the upper portions and not the other portion of the steel cylinder. The heating process may be executed at the second stop position immediately after the first stop position at which mounting of a steel cylinder occurs, or at any subsequent stop position before the hardness of the cylinder becomes so great that it is too difficult to be easily drawn. Thus, when the steel cylinder is located at the stop position for heating, a ringed high frequency induction heater is made to descend to and encircle the opening portion and electricity is made to flow in said heater for an interval of time equivalent to one stop cycle. The heated steel cylinder can be drawn by the subsequent drawing dies in series into the desired shape of a gas container.

This invention will be better understood and other objects and additional advantages of the invention will become apparent upon perusal of the following description in connection with the drawings, in which.

Figure 1:
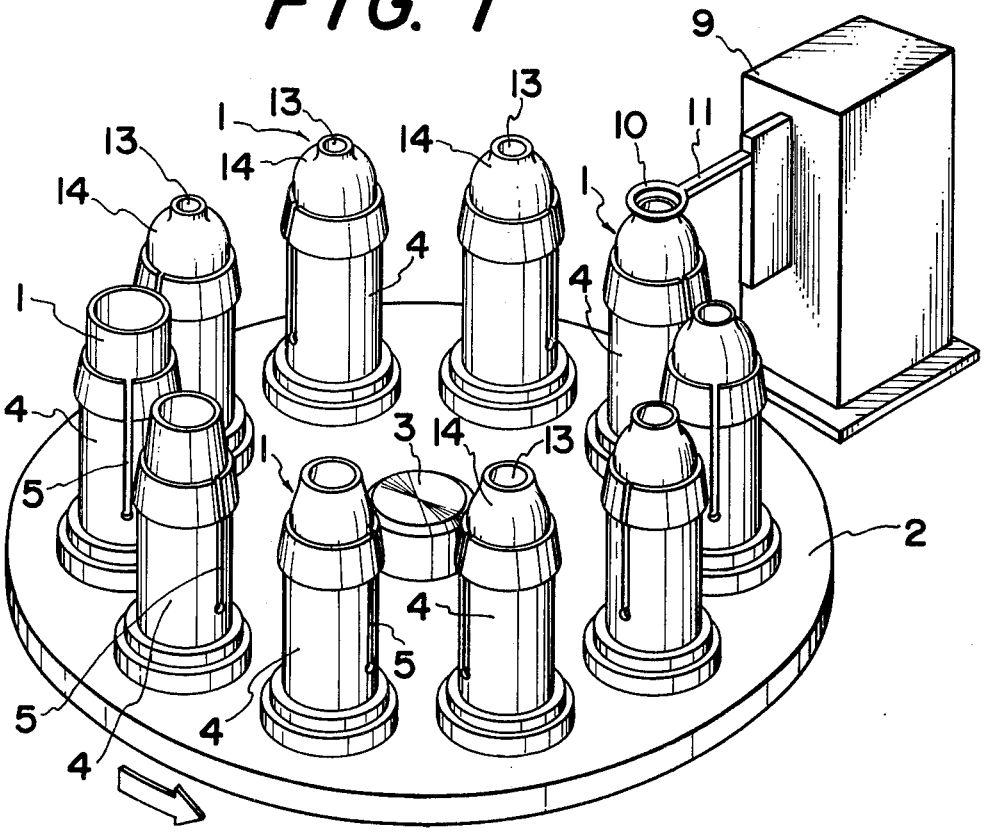
FIG. 1 is a perspective view of a turn table provided with a plurality of holding frames and an annealing means set on a device bed according to the present invention.
Figure 2:
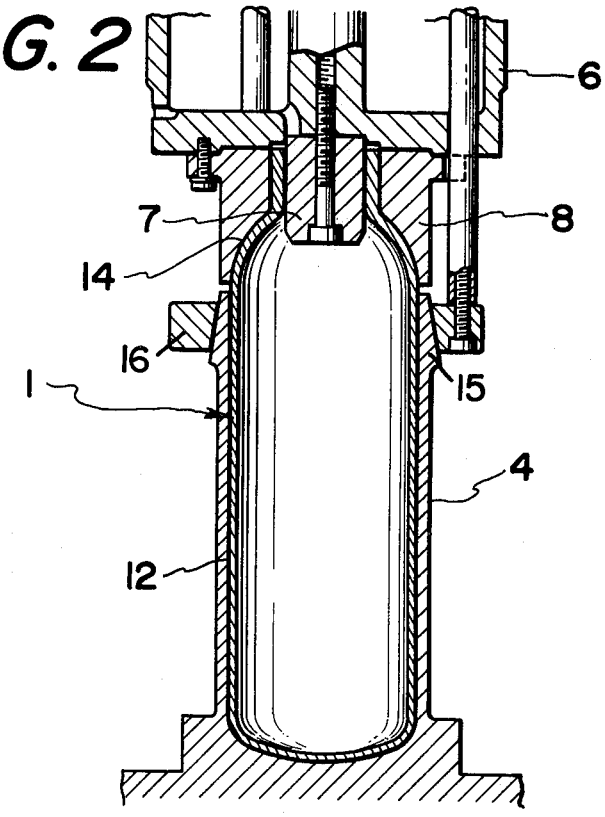
FIG. 2 is a sectional side elevation showing a holding frame, a drawing die and a steel cylinder at a point in the drawing operation.
Figure 3:
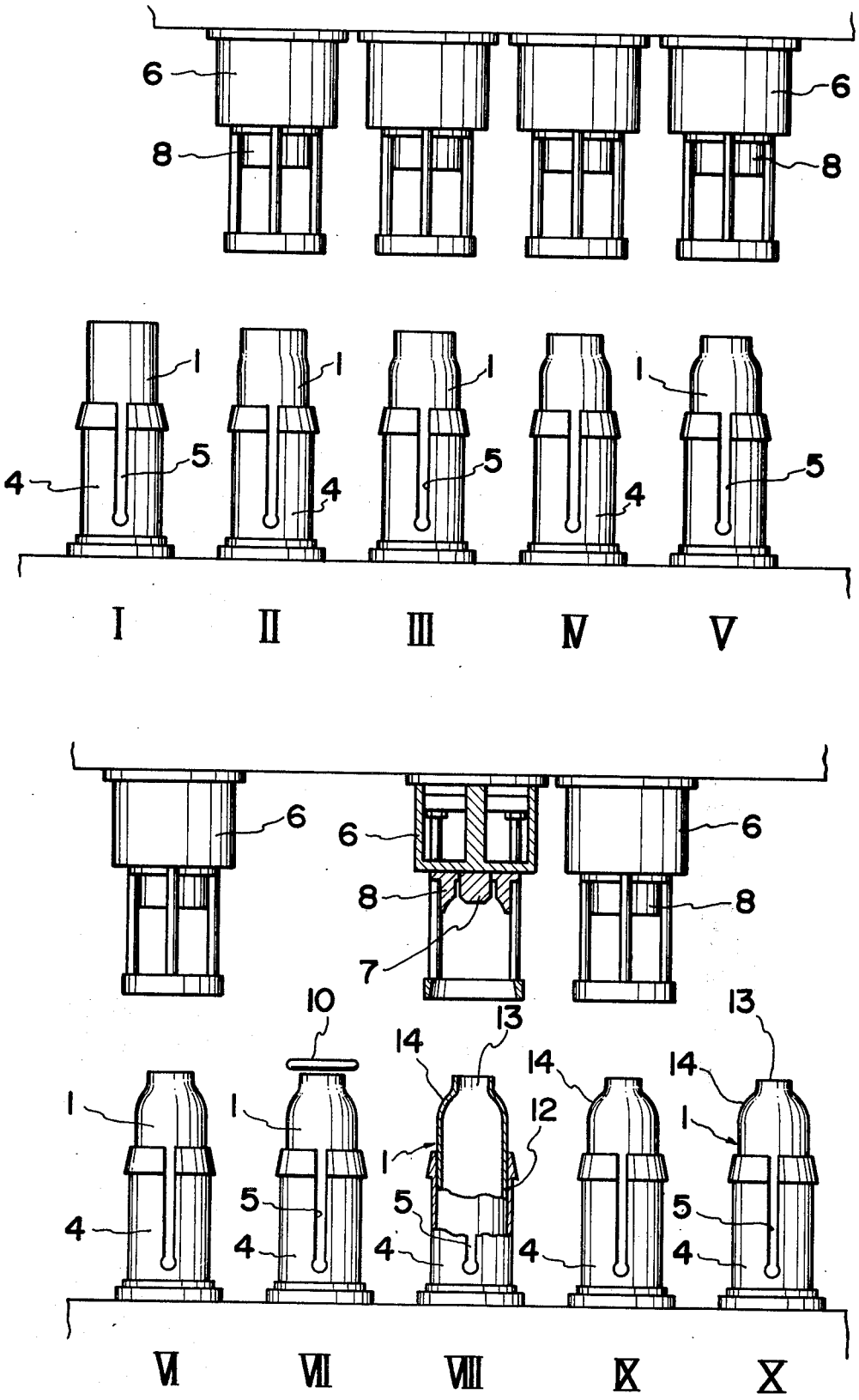
FIG. 3 is an explanatory elevational view illustrating the sequential operation of the holding frames which hold the steel cylinders, respectively, and the series of drawing dies which are arranged circularly on the turn table.

Referring more particularly to the drawings, some embodiments of this invention will now be described; however, this description will be understood to be illustrative of the invention and not as limiting it to the particular construction shown and described. The drawing device comprises a turn table or carrier 2, a plurality of cylindrical workpiece holding frames 4, a series of drawing dies 6 and an annealing or heating means 9 having a high frequency induction heater 10. The turn table 2 has a rotary shift 3 at its center and is adapted to turn intermittently in a direction as shown by the illustrated arrow through equal circumferential distances which correspond to dividing the circumference of the table 2 by total number of the holding frames 4. Thereupon, the table 2 is adapted to stop for an instant. Each of the cylindrical holding frames 4 has a vertical slit 5 on its side and is fixed to the turn table 2 at equally spaced distances along the circumference of said turn table 2. Each of the frames 4 has a cylindrical portion which is adapted to secure and firmly support the entire portion of the hollow cylindrical blank workpiece which will correspond to the trunk portion of the finished container. The cylindrical portion has a closed end for receiving the bottom end of the workpiece and an open end which has an annular lip 15 that is tapered on the outside surface of the frame 4. A bottomed steel cylinder 1 is inserted into and mounted to the respective holding frame 4 at the mounting position I. Right above the holding frames 4 at the subsequent stop positions II to VI and VIII to IX, a series of drawing dies 6 are installed; no dies are located at positions I, VII, and X where the mounting, heating, and the demounting steps occur. The dies are adapted to reciprocate vertically and simultaneously at each stop of the turn table 2. Each the drawing dies 6 comprises a punch 7 and a die 8, in combination, and forming one operable unit. The punch 7 has an outer cylindrical surface, and the die 8 has an inner cylindrical and downwardly widened shoulder-shaped surface. Each successive unit of the shaping means comprise the punch 7 and the die 8 which are formed with surfaces which are gradually less in diameter, respectively, and thereby widen gradually a space between the inner surface of the die 8 and the outer surface of the punch 7. When the turn table 2 stops, all of the drawing dies 6 descend to the bottomed steel cylinders 1 mounted on the holding frames 4, and the upper portions of the steel cylinders 1 are inserted by pressure into the cylindrical spaces of the drawing dies 6 and squeezed by the dimensional variations of the successive drawing dies 6 gradually into an opening portion of a gas container 1, respectively. The fastening ring 16 is connected with the drawing dies 6 and moves axially with the punch 7 and die 8 so as to cooperate with the tapered lip 15 and squeeze the upper portion of the cylindrical portion of the holding frame so as to securely hold the workpiece. During shaping, the trunk portion bears the pressure of the punch 7 and die 8 without wrinkling. Moreover, the opening portion is made gradually thicker without wrinkling or rumpling by employing the drawing dies 6 comprising the punch 7 and the die 8. The drawing process is performed in the circulation system on the turn table 2, and the bottomed steel cylinders 1 are processed automatically and successively into a gas container having a thick and narrow opening portion 13. However when the upper portion of the bottomed steel cylinder 1 is successively squeezed by the drawing dies 6, said portion becomes harder and virtually impossible to be squeezed any further. Then, a heating process is required for the subsequent drawing process. The heating process, however, may be performed at any of the stop positions selected from positions II to VII after the mounting position I. A ringed or annular high frequency electric induction heater 10 is fitted right above the heating position VII and is supported by an arm 11 which projects laterally from a heating means 9. The arm 11 is adapted to vertically descend and place the annular heater 10 about an opening portion 13 when the turn table 2 stops. One example will be described as follows. A semi-processed bottomed steel cylinder 1, which initially is 39.5 cm high, 12.8 cm in diameter and 1.6 mm thick, is drawn by the successive drawing device into a steel gas container which is 39.1 cm high, 12.8 cm in diameter at the trunk, 7.57 cm in diameter at the opening 13, 3.8 cm in height at the opening 13, 30.7 cm in height at the trunk, 4.6 cm in height at the roundish shoulder 14 and 3.2 mm in thickness at the opening 13. In this example, a heating operation is achieved at the temperature of 800°~900°C and applied for 10 seconds.

As stated above, the gas container drawn by the successive drawing device of this invention has no welding line at the shoulder portion and no rumpling lines at the opening portion and becomes about two times thicker at the opening portion in comparison with the initial thickness of the upper portion. Therefore, the thus produced gas container is very sturdy, especially at the opening portion, and is able to be threaded on the interior or exterior side of the opening portion.

While particular embodiments of this invention have been illustrated and described, modification thereof will readily occur to those skilled in the art. It should be understood, therefore, that the invention is not limited to the particular arrangements disclosed but that the appended claims are intended to cover all modifications which do not depart from the true spirit and scope of the invention.

I claim:

1. In an apparatus for converting a hollow cylindrical blank workpiece into a seamless container having a trunk and a neck portion connected by a shoulder portion, particularly a container able to withstand high internal pressures, a combination comprising a carrier having a plurality of spaced work stations; means for successively indexing said carrier to respective ones of said work stations; a plurality of workpiece-holding frames on said carrier and each having a cylindrical portion adapted to receive and firmly support the entire portion of a blank which will correspond to the trunk portion of the finished container; shaping means at some of said work stations adapted to move axially of the respective workpiece-holding frames for successively shaping an upper portion of the blank to form the shoulder and neck portions of the container; and clamping means at said working stations at which said shaping means are located for securely holding said workpieces during their shaping, including first cooperating means on said cylindrical portions and second cooperating means movable axially towards said cylindrical portions with said shaping means and into engagement with said first cooperating means so as to generate a radial clamping force on said cylindrical portions, whereby the firmly supported trunk portion of a blank is prevented from wrinkling under the effect of the axial movement of said shaping means during the conversion of the blank into a finished container.

2. A high pressure gas container produced by a successive drawing device as defined in claim 1.

3. A combination as defined in claim 1, wherein said carrier is a turntable and said work stations are equally spaced along the circumference of said turntable.

4. A combination as defined in claim 1, wherein said indexing means moves said frames to respective ones of said work stations and stops for a time period sufficient for each of said work stations to complete their respective functions.

5. A combination as defined in claim 1, wherein one of said work stations serves as a mounting station to receive fresh blank workpieces, and wherein a second one of said work stations serves as a demounting station to discharge finished containers.

6. A combination as defined in claim 1, wherein said frames are made of resilient material and have longitudinal slits so as to facilitate the holding of the workpieces.

7. A combination as defined in claim 1, wherein each of said shaping means comprises a punch having a contoured outer circumferential surface and a die having a contoured inner surface, the dimensions of said surfaces progressively varying at each successive work station so as to shape the upper portion of the blank to form the shoulder and neck portions of the container, said neck portion having a wall thickness which is larger than the wall thickness of the portion of the blank which corresponds to the trunk portion of a finished container so that said neck portion has sufficient wall thickness to be threaded.

8. A combination as defined in claim 1, wherein said cylindrical portion has an open end and a closed end, said first cooperating means comprising an annular tapered lip at said open end.

9. A combination as defined in claim 8, wherein said second corporating means comprises a fastening ring movable axially of the respective workpiece-holding frames and cooperatively engaging said tapered lip so as to securely hold the workpiece.

10. A combination as defined in claim 1 and further comprising heating means associated with at least one other of said work stations for thermally treating the upper portion of the respectively registered blank.

11. A combination as defined in claim 10, wherein said heating means is an annular high-frequency electric induction heater for thermally treating the upper portion of the respectively registered blank so as to facilitate the shaping by said shaping means.

12. A method of converting a hollow cylindrical blank workpiece into a seamless container having a trunk and a neck portion connected by a shoulder portion, particularly a container able to withstand high internal pressures, comprising the steps of firmly supporting the entire portion of a workpiece blank which will correspond to the trunk portion of the finished container by mounting the workpiece blank in a workpiece-holding frame provided on a carrier; successively indexing said carrier to a plurality of spaced work stations; successively shaping an upper portion of the respectively indexed workpiece blank to form the shoulder and neck portions of the container by effecting axial engagement of the upper portion of the blank with shaping means provided at some of said work stations; and axially moving a first clamping member into engagement with a second clamping member provided on said workpiece-holding frames during the step of shaping for securely holding each of the workpieces in respective ones of said workpiece-holding frames, whereby the firmly supported trunk portions of said workpiece blanks are prevented from wrinkling during the conversion of the respective workpiece blanks into finished containers.

13. A method as defined in claim 12; and further comprising the step of heating the upper portion of the respectively indexed workpiece blank at at least one other of said work stations.

14. In an apparatus for converting a hollow cylindrical blank workpiece into a seamless container having a trunk and a neck portion connected by a shoulder portion, particularly a container able to withstand high internal pressures, a combination comprising a carrier having a plurality of spaced work stations; means for successively indexing said carrier to respective ones of said work stations; a plurality of workpiece-holding frames on said carrier and each having a cylindrical portion adapted to receive and firmly support the entire portion of a blank which will correspond to the trunk portion of the finished container, said cylindrical portion having an open end and a closed end, said open end having an annular tapered lip; shaping means at some of said work stations adapted to move axially of the respective workpiece-holding frames for successively shaping an upper portion of the blank to form the shoulder and neck portions of the container, said shaping means further comprising a fastening ring movable axially of the respective workpiece-holding frames and cooperatively engaging said tapered lip so as to securely hold the workpiece; and heating means associated with at least one other of said work stations for thermally treating the upper portion of the respectively registered blank, whereby the firmly supported trunk portion of a blank is prevented from wrinkling under the effect of the axial movement of said shaping means during the conversion of the blank into a finished container.

* * * * *